US008774680B2

(12) United States Patent
Nimura

(10) Patent No.: US 8,774,680 B2
(45) Date of Patent: Jul. 8, 2014

(54) IMAGE FORMING APPARATUS USING ELECTROPHOTOGRAPHIC PROCESS

(75) Inventor: Masanori Nimura, Kashiwa (JP)

(73) Assignee: Canon Kabushiki Kaisha (JP)

( * ) Notice: Subject to any disclaimer, the term of this patent is extended or adjusted under 35 U.S.C. 154(b) by 145 days.

(21) Appl. No.: 13/047,213

(22) Filed: Mar. 14, 2011

(65) Prior Publication Data

US 2011/0229203 A1 Sep. 22, 2011

(30) Foreign Application Priority Data

Mar. 18, 2010 (JP) ..... 2010-062543

(51) Int. Cl.
*G03G 15/00* (2006.01)

(52) U.S. Cl.
USPC ..... 399/167

(58) Field of Classification Search
USPC ..... 399/167, 75, 82
See application file for complete search history.

(56) References Cited

U.S. PATENT DOCUMENTS

| | | | | |
|---|---|---|---|---|
| 6,173,141 | B1 | 1/2001 | Sakagami et al. | |
| 6,453,139 | B2 * | 9/2002 | Sasame et al. | 399/167 |
| 7,215,907 | B2 * | 5/2007 | Fukuchi et al. | 399/167 |
| 7,415,227 | B2 * | 8/2008 | Shimura et al. | 399/167 |
| 7,636,533 | B2 * | 12/2009 | Kikuchi et al. | 399/167 |
| 2005/0084293 | A1 | 4/2005 | Fukuchi et al. | |

FOREIGN PATENT DOCUMENTS

| | | | |
|---|---|---|---|
| CN | 1577140 | | 2/2005 |
| JP | 11-024356 | A | 1/1999 |
| JP | 2006146066 | A | 6/2006 |
| JP | 2008-096751 | A | 4/2008 |
| JP | 2008-197146 | A | 8/2008 |
| JP | 2009-042382 | A | 2/2009 |

OTHER PUBLICATIONS

Chinese Office Action issued in Chinese counterpart application No. CN201110069940.2, dated May 6, 2013. English translation provided.

Japanese Office Action cited in Japanese counterpart application No. JP2010-062543, dated Dec. 3, 2013.

Chinese Office Action issued in Chinese counterpart application No. CN201110069940.2, dated Jan. 24, 2014. English translation provided.

* cited by examiner

*Primary Examiner* — Clayton E LaBalle
*Assistant Examiner* — Victor Verbitsky
(74) *Attorney, Agent, or Firm* — Rossi, Kimms & McDowell LLP

(57) ABSTRACT

An image forming apparatus which is capable of reducing first print output time and preventing slack of an intermediate transfer belt in a monochrome mode. Surfaces of photosensitive drums are electrically charged and exposed to light, thereby allowing electrostatic latent images to be formed thereon. Developers are attached to the electrostatic latent images to form visible images transferred to the intermediate transfer belt. Among the photosensitive drums, a photosensitive drum used in the monochrome mode and the intermediate transfer belt are rotatably driven by a first rotatably driving unit, and photosensitive drums other than the photosensitive drum used in the monochrome mode are driven by a second rotatably driving unit. In the monochrome mode, the rotational speed of the second rotatably driving unit is controlled so as to be equal to or less than that of the first rotatably driving unit without adjusting rotation phases of the photosensitive drums.

4 Claims, 6 Drawing Sheets

IMAGE FORMING APPARATUS USING ELECTROPHOTOGRAPHIC PROCESS

BACKGROUND OF THE INVENTION

1. Field of the Invention

The present invention relates to an image forming apparatus, such as a copier or a printer, using an electrophotographic process.

2. Description of the Related Art

Conventionally, there have been known color image forming apparatuses having image forming means for forming images of four colors consisting of yellow (Y), magenta (M), cyan (C), and black (Bk). Those color image forming apparatuses perform image formation by transferring toner images, which are born on image bearing members for the respective colors, to an intermediate transfer unit, and transferring the toner images on the intermediate transfer unit to a sheet.

Such color image forming apparatuses have the problem that color shift occurs when image forming positions of the four colors become misaligned, and the color shift presents itself in an image, resulting in degradation of image quality. The color shift is caused by shaft deflection, nonuniform rotation, nonuniform speed, etc. of the image bearing members which are rotating.

As measures concerning the color shift, there have been proposed, for example, a method to prevent the color shift by individually controlling rotation phases of the image bearing members for the respective colors. For example, a group of color image bearing members on which color images are formed and a black image bearing member on which a black image is formed are driven by motors which are different rotatably driving means, and the motor that drives the black image bearing member drives an intermediate transfer unit as well. There has been proposed an adjustment method that, in the arrangement described above, the rotation phase of the motor that drives the black image bearing member and the intermediate transfer unit is used as the reference, and the rotation phase of the motor that drives the group of color image bearing members is matched with the rotation phase of the motor that drives the black image bearing member and the intermediate transfer unit (see Japanese Laid-Open Patent Publication (Kokai) No. 2008-197146, for example).

According to the technique disclosed in Japanese Laid-Open Patent Publication (Kokai) No. 2008-197146, control has to be performed so as to match the rotation phase of the motor that drives the black image bearing member and the rotation phase of the motor that drives the group of color image bearing members with each other. For this reason, control is performed to activate the motors step by step so as to minimize the likelihood of phase shift during the activation. More specifically, to reduce convergence time, the phase control at the activation of the motors is started with reference to the motor that drives the black image bearing member at a time point each motor reaches a predetermined speed, and as soon as the phase control is completed within a predetermined time period, image formation is started.

However, there is the problem that if the phase control for the color motor is performed in a monochrome mode in which images are formed in only black color, this will end up increasing first print output time. Also, there is the problem that if the rotational speed of the color motor is higher than that of the motor that drives the black image bearing member, the intermediate transfer unit will slack due to rotation of the color motor following the movement of the intermediate transfer belt because the motor that drives the black image bearing member drives the intermediate transfer unit as well.

SUMMARY OF THE INVENTION

The present invention provides an image forming apparatus which is capable of reducing first print output time and preventing slack of an intermediate transfer unit in a monochrome mode.

The present invention in its aspect provides an image forming apparatus comprising: a plurality of image bearing members configured to be electrically charged at surfaces thereof, a plurality of exposing units configured to expose the electrically charged surfaces of the image bearing members to light and thus form electrostatic latent images; a plurality of developing units configured to attach developers to the electrostatic latent images to thereby form visible images; an intermediate transfer unit to which the visible images formed on the surfaces of the plurality of image bearing members are transferred; a first rotatably driving unit configured to rotatably drive, among the plurality of image bearing members, an image bearing member used in a monochrome mode and the intermediate transfer unit; a second rotatably driving unit configured to rotatably drive, among the plurality of image bearing members, image bearing members other than the image bearing members used in the monochrome mode; a phase detecting unit configured to detect rotation phases of the plurality of image bearing members; and a control unit configured to control rotation phases of the plurality of image bearing members based on the detection results of the phase detecting unit, wherein the control unit controls, in performing image formation in the monochrome mode, a rotational speed of the second rotatably driving unit so as to be equal to or less than a rotational speed of the first rotatably driving unit without adjusting the rotation phases of the plurality of image bearing members.

According to the present invention, it is possible to reduce first print output time, and prevent slack of an intermediate transfer unit can be prevented in a monochrome mode.

Further features of the present invention will become apparent from the following description of exemplary embodiments with reference to the attached drawings.

DESCRIPTION OF THE EMBODIMENTS

The present invention will now be described with reference to the accompanying drawings showing an image forming apparatus according to an embodiment thereof.

Figure 1:
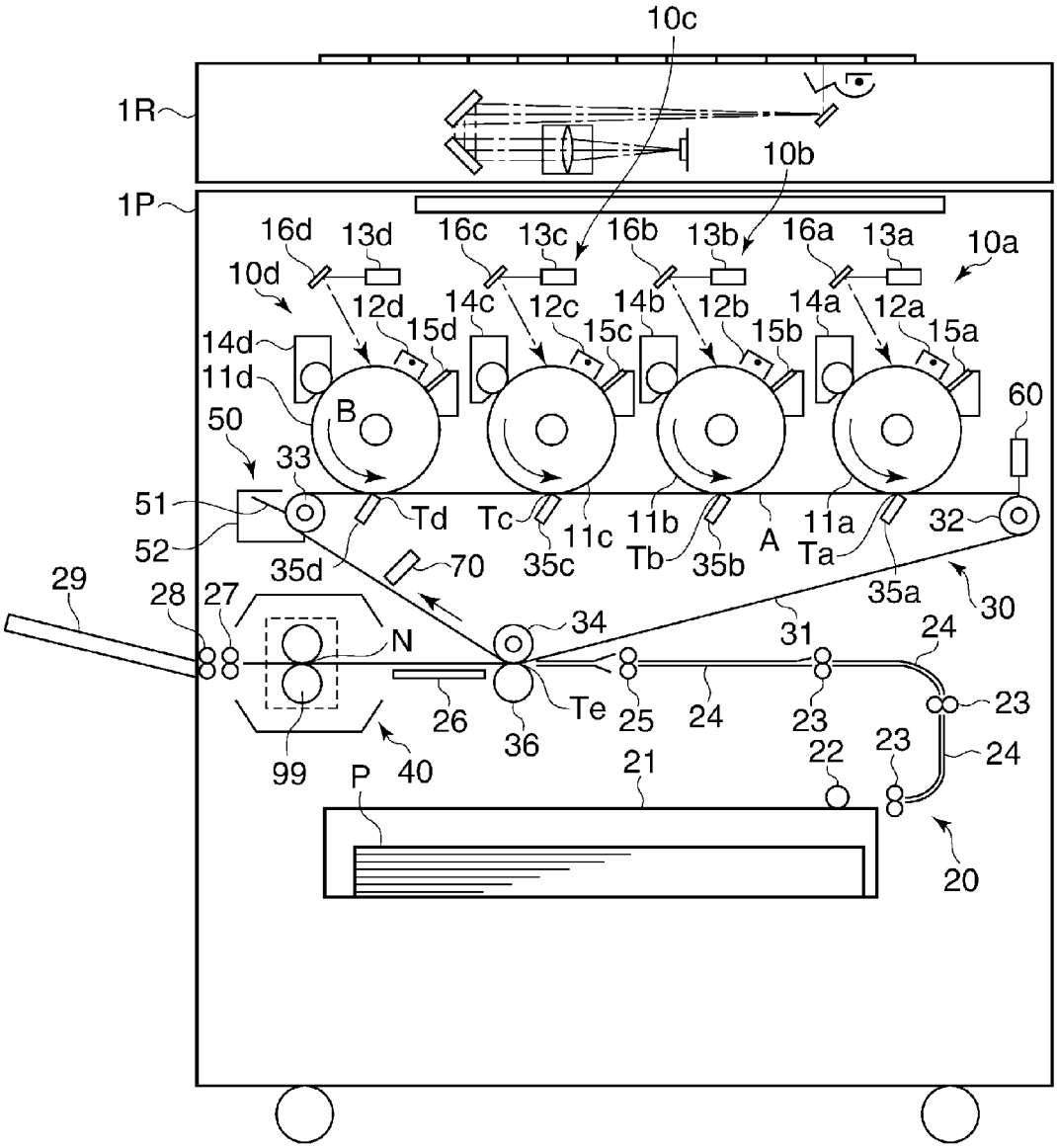
FIG. 1 is a cross-sectional view schematically showing an arrangement of an image forming apparatus according to an embodiment of the present invention.

FIG. 1 is a cross-sectional view schematically showing an arrangement of an image forming apparatus according to an embodiment of the present invention.

The image forming apparatus is a color copier which has a plurality of image forming units placed in parallel therein, and which uses an electrophotographic process for which an intermediate transfer system is employed. The image forming apparatus has a console (not shown), an image reading unit 1R, and an image output unit 1P.

The console has an operation panel, buttons, and so on for setting copying conditions, and after a process is started in the image forming apparatus, the progress thereof and others are displayed on the operation panel. A detailed description will be given later of the console with reference to FIG. 2.

The image reading unit 1R optically reads an image on an original, converts the image to an electric signal, and sends the electric signal to the image output unit 1P. The image output unit 1P has four image forming units 10*a*, 10*b*, 10*c*, and 10*d*, a sheet feeding unit 20, an intermediate transfer unit 30, and a fixing unit 40.

The image forming units 10*a*, 10*b*, 10*c*, and 10*d* are identical in construction with one another. The image forming units 10*a*, 10*b*, 10*c*, and 10*d* have, as an image bearing member, drum-shaped electrophotographic photosensitive units (hereafter referred to as "the photosensitive drums") 11*a*, 11*b*, 11*c*, and 11*d*, respectively, which are pivotally supported and rotatably driven in directions indicated by arrows.

Primary chargers 12*a* to 12*c*, optical systems 13*a* to 13*d*, mirrors 16*a* to 16*d*, developing units 14*a* to 14*d*, and cleaning units 15*a* to 15*d* are placed in this order in the rotational directions (arrows B) of the photosensitive drum 11*a* to 11*d* and in opposed relation to outer peripheral surfaces of the photosensitive drums 11*a* to 11*d*.

The primary chargers 12*a* to 12*c* apply uniform amounts of electrical charges to surfaces of the photosensitive drum 11*a* to 11*d*. The optical systems 13*a* to 13*d* expose the photosensitive drums 11*a* to 11*d* to light beams such as laser beams, which have been modulated according to a recorded image reading signal from the image reading unit 1R, via the mirrors 16*a* to 16*d*. As a result, electrostatic latent images are formed on the photosensitive drum 11*a* to 11*d*.

The developing units 14*a* to 14*d* store developers (hereafter referred to as "toners") of four colors consisting of black (Bk), cyan (C), magenta (M), and yellow (Y), respectively. By attaching the stored toners to the electrostatic latent images formed on the photosensitive drum 11*a* to 11*d*, the developing units 14*a* to 14*d* make the electrostatic latent images visible (develop) to form visible images (toner images).

The toner images made visible on the photosensitive drum 11*a* to 11*d* are transferred to an intermediate transfer belt 31, which is a belt-shaped intermediate transfer unit, in primary transfer regions Ta to Td. It should be noted that the intermediate transfer belt 31 is a constituent element of the intermediate transfer unit 30. A detailed description will be given later of an arrangement of the intermediate transfer unit 30.

In areas downstream of the primary transfer regions Ta to Td, the cleaning units 15*a* to 15*d* clean the surfaces of the photosensitive drum 11*a* to 11*d* by scraping off toner which remains on the photosensitive drums 11*a* to 11*d* without being transferred to the intermediate transfer belt 31.

The sheet feeding unit 20 has a cassette 21 that stores transfer materials P as recording materials, and a pickup roller 22 that feeds the transfer materials P one by one from the cassette 21. The sheet feeding cassette 20 also has sheet feeding roller pairs 23 that convey each transfer material P fed from the pickup roller 22, a sheet feeding guide 24, and registration rollers 25 that feed each transfer material P in accordance with the timing of image formation in the image forming units 10 to 10*d*.

The intermediate transfer unit 30 has a driving roller 32 for driving the intermediate transfer belt 31, a driven roller 33 that applies proper tension to the intermediate transfer belt 31 by urging the same with a spring, not shown, and a secondary transfer roller 34 for transferring a visible image from the intermediate transfer belt 31 to a transfer material P.

The intermediate transfer belt 31 is held wounded around the driving roller 32, the driven roller 33, and the secondary transfer roller 34 in a tensioned state, and a primary transfer plane A is formed between the driving roller 32 and the driven roller 33.

The intermediate transfer belt 31 is made of, for example, PET (polyethylene terephthalate), PVDF (polyvinylidene fluoride), or the like. The driving roller 32 is constructed by coating the surface of a metallic roller with rubber (for example, urethane rubber or chloroprene rubber) with a thickness of several millimeters, and this prevents the driving roller 32 from slipping off the intermediate transfer belt 31. As will be described later, the driving roller 32 is rotatably driven using a black (Bk) motor 303 (see FIG. 3) that rotates the black (Bk) photosensitive drum 11*a*.

In the primary transfer regions Ta to Td where the photosensitive drums 11*a* to 11*d* and the intermediate transfer belt 31 are opposed to each other, primary transfer chargers 35*a* to 35*d* are disposed on a back side of the intermediate transfer belt 31. Also, a secondary transfer roller 36 is disposed in opposed relation to the secondary transfer roller 34, and a secondary transfer region Te is formed by a nip between the intermediate transfer belt 31 and the secondary transfer roller 36. The secondary transfer roller 36 is held while applying moderate pressure to the intermediate transfer belt 31.

The fixing unit 40 has fixing roller pairs 99 that fix a visible image (toner image), which has been transferred to a transfer material P, onto the transfer material P while conveying the transfer material P, and fixing heaters 111 (see FIG. 2) that heat the fixing rollers 99 so as to fix the toner image to the transfer material P.

The image output unit 1P also has a cleaning unit 50, a cleaning blade 70, a photo-sensor 60, and a control unit (not shown).

The cleaning unit 50 is disposed downstream of the secondary transfer region Te of the intermediate transfer belt 31, and cleans an image-bearing surface of the intermediate transfer belt 31. The cleaning unit 50 has a cleaning blade 51 that removes toner on the intermediate transfer belt 31, and a waste toner box 52 in which waste toner removed from the intermediate transfer belt 31 is stored.

The cleaning blade 70 is disposed for the intermediate transfer belt 31 between the secondary transfer region Te and the cleaning unit 50. The cleaning blade 70 is removable from the intermediate transfer belt 31 by a pulse motor (not shown), and is used to remove toner on the intermediate transfer belt 31.

The photo-sensor 60 monitors rotation of the driving roller 32. The control unit has a CPU for providing centralized control of the image forming apparatus, a registration correction circuit, a motor driver unit, and so on. A detailed description will be given later of the control unit with reference to FIG. 2.

It should be noted that the image output unit 1P has a conveying guide 26 that guides a transfer material P to a nip N between the fixing rollers 99, and inner sheet discharging rollers 27 and outer sheet discharging rollers 28 that discharge transfer materials P discharged from the fixing unit 40 to an outside of the image forming apparatus. The transfer materials P discharged from the image forming apparatus are stacked on a discharged sheet tray 29.

When the image reading unit 1R reads an image on an original, the control unit sends predetermined signals, data, and so on for starting image formation to the component parts of the image output unit 1P, and as a result, operations in the component parts of the image output unit 1P are started.

Based on a sheet size and others selected when the image on the original is read, predetermined transfer materials P are fed one by one from the cassette 21 in the sheet feeding unit 20 by the pickup roller 22. Each transfer material P is guided between the sheet feeding guides 24 by the sheet feeding roller pairs 23, and conveyed to the registration rollers 25. At this time, the registration rollers 25 are at a standstill, and hence a leading end of the transfer material P abuts on a nip between the registration rollers 25.

The registration rollers 25 start rotating in accordance with the start timing of image formation in the image forming units 10*a* to 10*d*. Specifically, the rotation timing of the registration rollers 25 is set so that in the secondary transfer region Te, toner images primarily transferred to the intermediate transfer belt 31 by the image forming units 10*a* to 10*d* can overlap with the transfer material P being conveyed.

The image forming units 10*a* to 10*d* form electrostatic latent images on the photosensitive drums 11*a* to 11*d* and make the electrostatic latent images visible based on image formation start signals and image data of the image on the original read by the image reading unit 1R.

Then, a toner image formed on the photosensitive drum 11*d* located on the uppermost stream side in the rotational direction of the intermediate transfer belt 31 is primarily transferred to the intermediate transfer belt 31. This primary transfer is done by applying high voltage to the primary transfer charger 35*d* and thus transferring the toner image on the photosensitive drum 11*d* to the intermediate transfer belt 31 in the primary transfer region Td.

The tone image thus transferred to the intermediate transfer belt 31 is conveyed to the next primary transfer region Tc. Image formation performed by the image forming unit 10*c* is delayed by a time period for which the toner image is conveyed from the primary transfer region Td to the primary transfer region Td, and a toner image formed by the image forming unit 10*c* is primarily transferred onto the toner image transferred in the primary transfer region Td in registration with each other.

Thereafter, in succession by the same process, primary transfer of a toner image formed by the image forming unit 10*b* to the intermediate transfer belt 31 is performed in the primary transfer region Tb, and primary transfer of a toner image formed by the image forming unit 10*a* to the intermediate transfer belt 31 is performed in the primary transfer region Ta. Thus, the toner images of the four colors are primarily transferred to the intermediate transfer belt 31. The toner images of the four colors transferred to the intermediate transfer belt 31 are sent to the secondary transfer region Te.

When the transfer material P enters the secondary transfer region Te and comes into contact with the intermediate transfer belt 31, high voltage is applied to the secondary transfer roller 36 in accordance with the timing of passage of the transfer material P. As a result, the toner images of the four colors formed on the intermediate transfer belt 31 are transferred to a surface of the transfer material P. After that, the transfer material P is precisely guided to the nip N of the fixing unit 40 by the conveying guide 26.

In the fixing unit 40, the transfer material P is conveyed while being supported from both sides thereof by the nip N, and in this conveying process, the toner images are fixed to the surface of the transfer material P by heat and pressure. The transfer material P passing through the nip N of the fixing unit 40 is discharged onto the discharged sheet tray 29 by the inner sheet discharging rollers 27 and the outer sheet discharging rollers 28.

Figure 2:
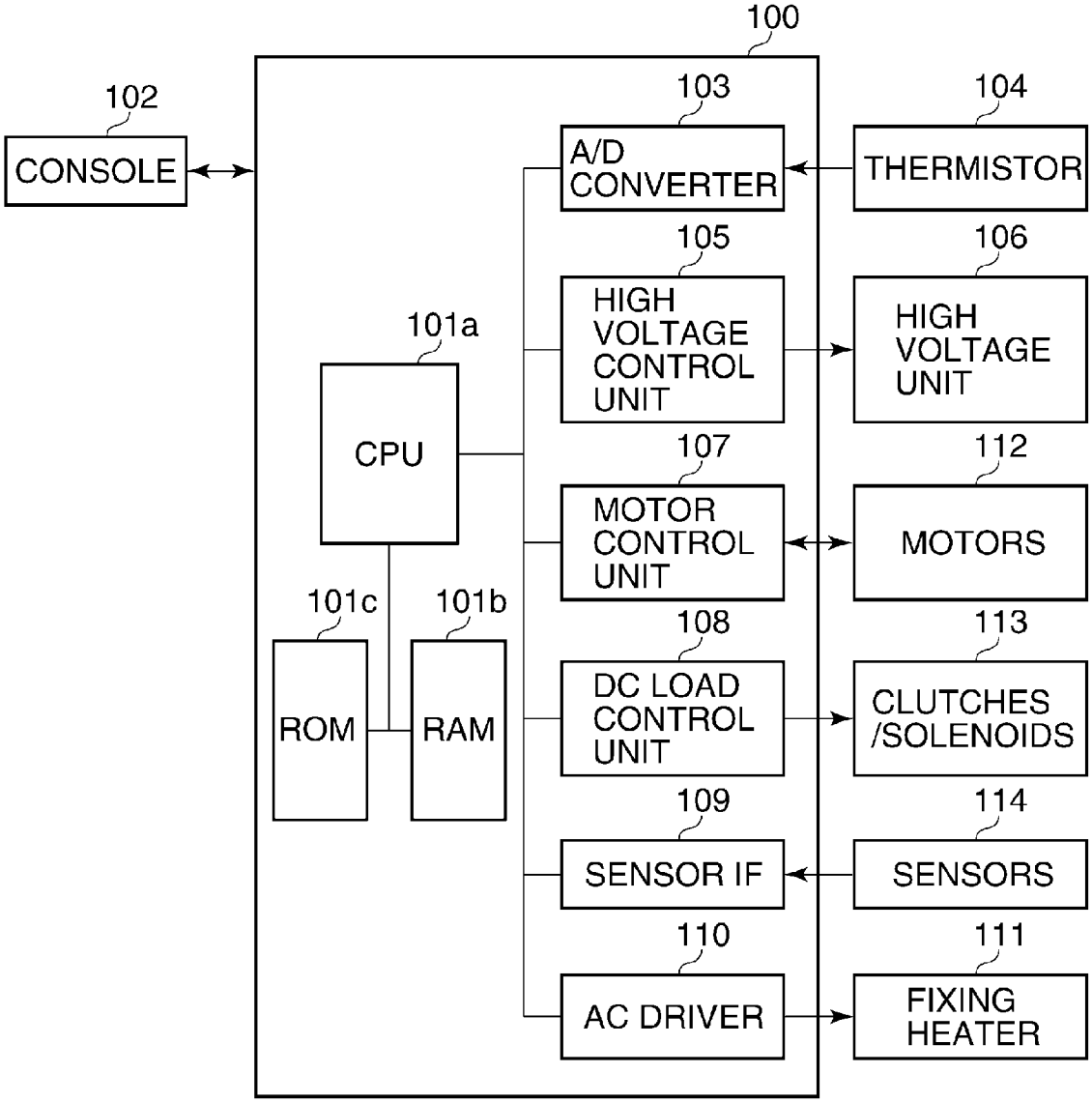
FIG. 2 is a block diagram showing an arrangement of a control unit of the image forming apparatus of FIG. 1.

FIG. 2 is a block diagram showing the control unit of the image forming apparatus of FIG. 1. The image forming apparatus is subjected to centralized control by the control unit 100. Specifically, the control unit 100 controls the console 102, and also controls the overall operation of the image forming apparatus by driving various driving elements constituting the image forming apparatus, and performing collection, analysis, and so on of information from sensors based on operational information on the console 102.

The control unit 100 has a ROM 101*b* for storing programs for executing various processes (image forming sequences) performed by the image forming apparatus, and a CPU 101*a* that executes the programs stored in the ROM 101*b*. The control unit 100 has a RAM 101*c* for storing rewritable data that need to be temporarily or permanently stored. The RAM 101*c* is also used as an area where the programs stored in the ROM 101*b* are expanded. Stored in the RAM 101*c* are, for example, high voltage setting values and various data for a high voltage control unit 105, to be described later, and instruction information on image formation from the console 102.

The console 102 is used to set information such as copy magnification, density setting values, and the number of copies by an operator of the image forming apparatus, and sends to the operator, for example, information about the number of images to be formed, and whether or not image formation is underway, and information about statuses of the image forming apparatus such as occurrence of a jam and a location of the jam.

The image forming apparatus has motors 112 that rotate rotational parts such as the photosensitive drums 11*a* to 11*d* and the driving roller 32, DC loads such as a clutches/solenoids 113, and sensors 114 such as a photo interrupter and a microswitch. In the image forming apparatus, the motors 112 and the DC loads are driven as appropriate to convey transfer materials P and drive various units, and their operations are monitored by the sensors 114.

In the control unit 100, signals from the sensors 114 are processed by the CPU 101*a* via a sensor I/F (interface) 109. Based on signals from the sensors 114, the CPU 101*a* sends signals for controlling the motors 112 to a motor control unit 107, and at the same time, sends signals for operating the clutches/solenoids 113 to a DC load control unit 108. Thus, appropriately operating the motors 12 and the clutches/solenoids 113 enable image formation to smoothly proceed in the image output unit 1P.

A high voltage unit 106 applies appropriate high voltages to various chargers (the primary chargers 12*a* to 12*d*, the primary transfer chargers 35*a* to 35*d*, and developing rollers of the developing units 14*a* to 14*d*) disposed in the image forming apparatus. The high voltage unit 106 operates in accordance with high-voltage control signals from the high-voltage control unit 105.

The fixing rollers 99 have the respective fixing heaters 111 built-in, and the fixing heaters 111 are turned on and off by an AC driver 110. The temperature of the fixing heaters 111 is measured by a thermistor 104. A change in the resistance value of the thermistor 104 responsive to a change in the temperature of the fixing heater 111 is converted to a voltage value, then converted to a digital value by an A/D converter 103, and input to the control unit 100. The AC driver 110 is controlled based on the temperature data.

Figure 3:
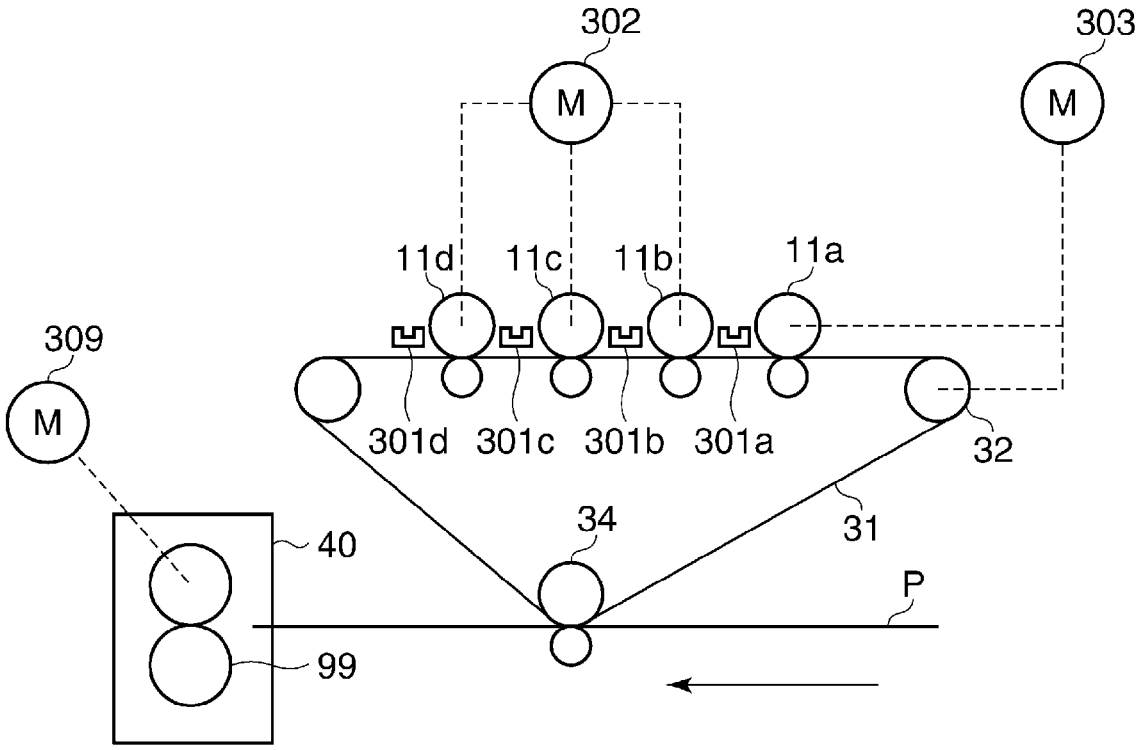
FIG. 3 is a view schematically showing a manner of driving a photosensitive drum and an intermediate transfer belt in the image forming apparatus of FIG. 1.

FIG. 3 is a view schematically showing a manner of driving the photosensitive drums 11*a* to 11*d* and the intermediate transfer belt 31 in the image forming apparatus of FIG. 1. FIG. 3 is drawn with FIG. 1 simplified, and among elements shown in FIG. 3, elements corresponding to those in FIG. 1 are designated by the same reference numerals.

As described earlier, according to the colors of toners stored in the developing units 14*a* to 14*d* (see FIG. 1), the photosensitive drums 11*a*, 11*b*, 11*c*, and 11*d* are used to form electrostatic latent images for black (Bk), cyan (C), magenta (M), and yellow (Y) visible images, respectively.

The photosensitive drum 11*a* is driven by the Bk motor 303 as a first rotatably driving unit, and the Bk motor 303 drives the intermediate transfer belt 31 as well. Namely, the Bk motor 303 rotatably drives the driving roller 32 as well. The photosensitive drums 11*b* to 11*d* are driven by a color CL motor 302 as a second rotatably driving unit.

Rotation phases of the photosensitive drums 11*a* to 11*d* are detected by respective phase sensors 301*a* to 301*d*. The fixing rollers 99 are driven by a motor 309. The phase sensors 301*a* to 301*d* detect rotations of the photosensitive drums 11*a* to 11*d* by generating light such as laser light to the photosensitive drums 11*a* to 11*d*, and receiving light reflected from them. Based on the detection results obtained by the phase sensors 301*a* to 301*d*, the control unit 100 controls rotatably driving operations of the CL motor 302 and the Bk motor 303.

It should be noted that before shipment of the image forming apparatus, the photosensitive drums 11*a* to 11*d* and the intermediate transfer belt 31 are spaced from each other. However, FIG. 3 shows a state in which the photosensitive drums 11*a* to 11*d* and the intermediate transfer belt 31 are used in a normal image formation sequence, and the photosensitive drums 11*a* to 11*d* and the intermediate transfer belt 31 are not spaced from each other in FIG. 3.

Figure 4:
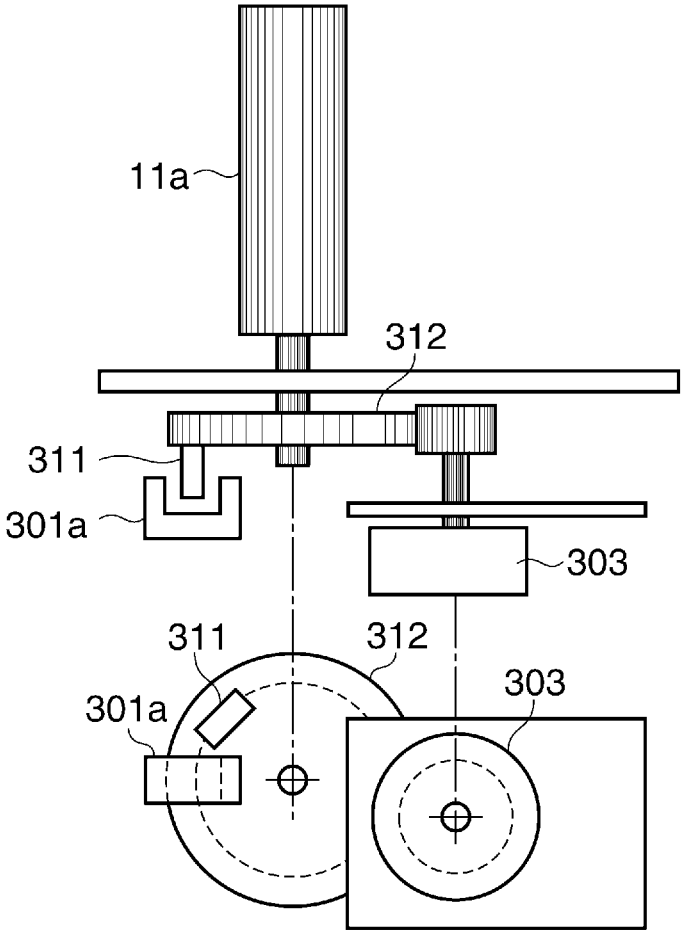
FIG. 4 is a view showing a mechanism of rotatably driving the photosensitive drum in the image forming apparatus of FIG. 1.

FIG. 4 is a view showing a mechanism of rotatably driving the photosensitive drum 11*a* in the image forming apparatus of FIG. 1. The Bk motor 303 rotates in conjunction with the photosensitive drum 11*a*, and is engaged with a gear 312 that rotatably drives the photosensitive drum 11*a*. The gear 312 is provided with a flagpole 311, which obstructs an optical path for light generated from the phase sensor 301*a* as the photosensitive drum 11*a* rotates, which enables the phase sensor 301*a* to detect one signal at each turn of the photosensitive drum 11*a* and output the signal to the sensor I/F 109.

It should be noted that the optical path for light generated from the phase sensor 301*a* is obstructed by the flagpole 311 which is disposed on the photosensitive drum 11*a* or a shaft disposed integrally on the photosensitive drum 11*a*. The photosensitive drums 11*b* to 11*d* are rotatably driven by power transmitted from the CL motor 302 (see FIG. 3), and phases of the photosensitive drums 11*b* to 11*d* are detected in the same manner as is the case with the photosensitive drum 11*a*, description of which is, therefore, omitted here.

When black-and-white copying as a mode of forming images in only black color is selected through operation on the console 102 by the operator, the image forming apparatus starts operation in a black (Bk) monochrome mode, and when color copying is selected as the image forming mode, the image forming apparatus starts operation in a full-color mode.

Figure 5:
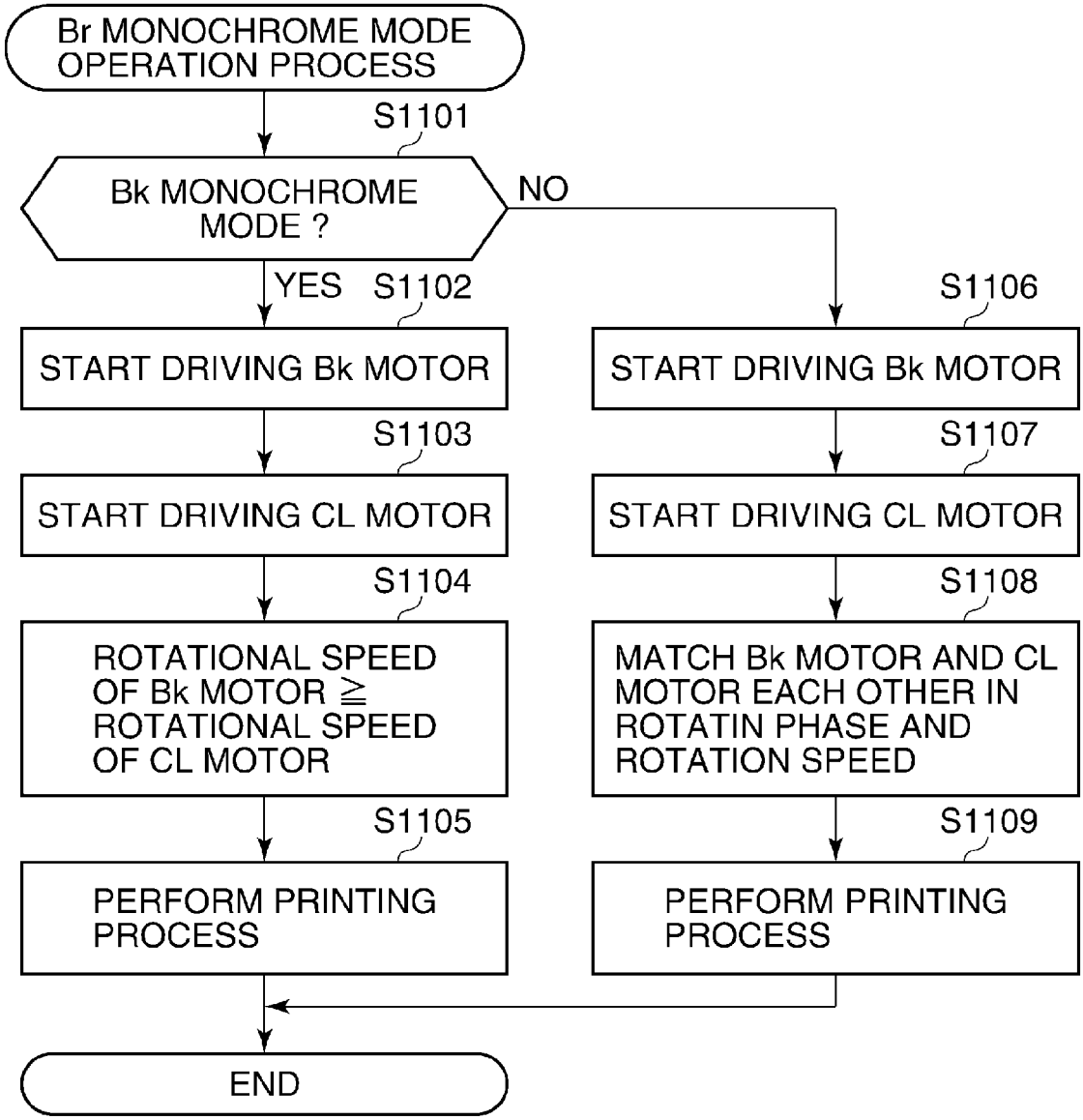
FIG. 5 is a flowchart showing the procedure of a black (Bk) monochrome mode operation process performed by the image forming apparatus of FIG. 1.

FIG. 5 is a flowchart showing the procedure of a black (Bk) monochrome mode operation process performed by the image forming apparatus of FIG. 1.

In FIG. 1, first, it is determined whether or not the black (Bk) monochrome mode is selected by the operator (step S1101). When the Bk monochrome mode is selected (YES to the step S1101), the control unit 100 starts driving the Bk motor 303 that drives the photosensitive drum 11*a* (step S1102), and then starts driving the CL motor 302 (step S1103).

As is distinct from the full-color mode, the Bk monochrome mode operation eliminates the need for considering color shift of the black (Bk), cyan (C), magenta (M), and yellow (Y) colors, which requires no control of matching the phases of the CL motor 302 and the Bk motor 303 together, but causes the rotational speed of the CL motor 302 to be controlled so as to be equal to or lower than that of the Bk motor 303 (step S1104).

This speed control is performed by the control unit 100 determining the rotational speed of the Bk motor 303 based on the number of pulses output from the phase sensor 301*a* that detects the rotation phase of the photosensitive drum 11*a*, and determining the speed of the CL motor 302 based on the determined rotational speed of the Bk motor 303.

Figure 6:
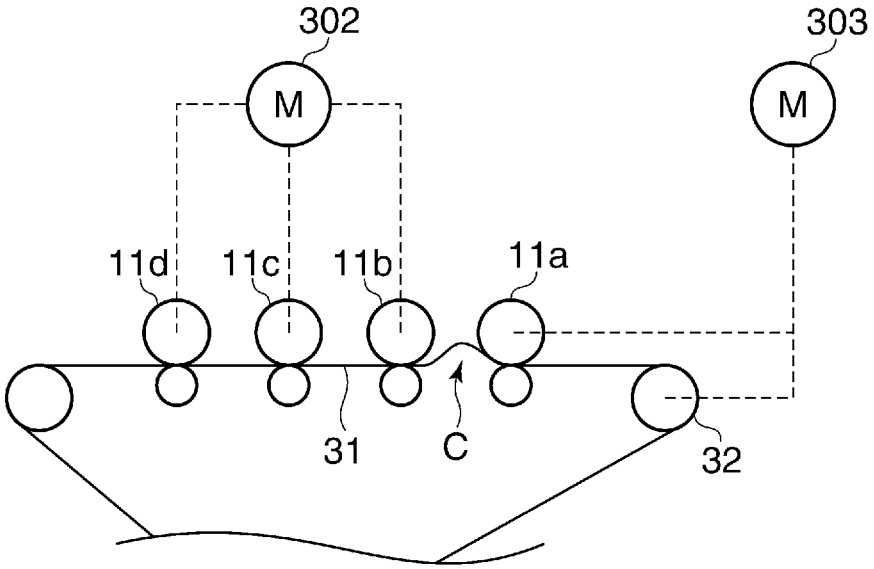
FIG. 6 is a view which is useful in explaining a state in which the intermediate transfer belt in the image forming apparatus slacks.

FIG. 6 is a view which is useful in explaining a state in which the intermediate transfer belt 31 slacks. When the speed of the CL motor 302 is higher than that of the Bk motor 303 that drives the Bk photosensitive drum 11*a* and the intermediate transfer belt 31, the intermediate transfer belt 31 may slack before the Bk photosensitive drum 11*a* as indicated by an arrow C in FIG. 6, which makes the rotational speed of the CL motor 302 lower than that of the Bk motor 303. Namely, making the rotational speed of the photosensitive drums 11*b* to 11*d* equal to or lower than that of the photosensitive drum 11*a* prevents the intermediate transfer belt 31 from slacking.

After the rotational speeds of the CL motor 302 and the Bk motor 303 are thus controlled, a printing process is performed in accordance with the print sequence described above (step S1105), followed by the process terminating.

On the other hand, when the full-color mode is selected (NO to the step S1101), the control unit 100 starts driving the CL motor 302 that drives the photosensitive drums 11*b* to 11*d*, and driving the Bk motor 303 that drives the photosensitive drum 11*a*. At this time, the control unit 100 starts driving the Bk motor 303 first (step S1106), and then starts driving the CL motor 302 (step S1107).

In the full-color mode, the rotation phases and rotational speeds of the CL motor 302 and the Bk motor 303 are matched together (step S1108). After the rotational speeds of the CL motor 302 and the Bk motor 303 are made uniform, a printing process is performed in accordance with the print sequence described above (step S1109), followed by the process terminating.

As described above, in the Bk monochrome mode, control of adjusting the rotation phase of the CL motor 302 and the Bk motor 303 is not performed, which reduces the load on the control unit 100 to thereby shorten first print output time.

Moreover, the intermediate transfer belt 31 is driven by the Bk motor 303, thereby allowing the Bk photosensitive drum 11*a* to be driven at the same speed as the intermediate transfer belt 31, which enables, using the Bk photosensitive drum 11*a* as the reference, the phases of the other colors to be easily matched together to correct for color shift. It should be noted that the Bk motor 303 may be configured to drive the Bk developing unit 14*a*, and the CL motor 302 may be configured in the same manner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-062543 filed Mar. 18, 2010, which is hereby incorporated by reference herein in its entirety.

What is claimed is:

1. An image forming apparatus comprising:

a plurality of image bearing members configured to be electrically charged at surfaces thereof;

a plurality of exposing units configured to expose the electrically charged surfaces of said image bearing members to light and thus form electrostatic latent images;

a plurality of developing units configured to attach developers to the electrostatic latent images to thereby form visible images;

an intermediate transfer unit to which the visible images formed on the surfaces of said plurality of image bearing members are transferred;

a first rotatably driving unit configured to rotatably drive, among said plurality of image bearing members, a first image bearing member used in a monochrome mode and said intermediate transfer unit;

a second rotatably driving unit configured to rotatably drive, among said plurality of image bearing members, second image bearing members other than the first image bearing member used in the monochrome mode;

a phase detecting unit configured to detect phases of rotation of said plurality of image bearing members; and a control unit configured to control the phases of rotation of said plurality of image bearing members based on the detection results of said phase detecting unit, wherein said control unit controls, in performing image formation in the monochrome mode, said first rotatably driving unit and said second rotatably driving unit so that a rotational speed of said second rotatably driving unit is slower than a rotational speed of said first rotatably driving unit without adjusting the phases of rotation of said plurality of image bearing members, while driving both the first and second rotatably driving units.

2. The image forming apparatus according to claim 1, wherein said first rotatably driving unit is configured to rotatably drive said first image bearing member used for forming a visible image using a black developer.

3. The image forming apparatus according to claim 2, wherein said first rotatably driving unit is also configured to drive said developing unit that forms a visible image using the black developer, among said plurality of developing units.

4. The image forming apparatus according to claim 3, wherein said second rotatably driving unit is configured to drive said developing units other than said developing unit that forms the visible image using the black developer, among said plurality of developing units.

* * * * *